United States Patent [19]

Montalbano

[11] 4,138,689

[45] Feb. 6, 1979

[54] ROCKABLE PHOTOGRAPHIC TRAY HAVING A SUBSTANTIALLY FLAT INTERIOR SHEET SUPPORT

[75] Inventor: Anthony P. Montalbano, Glen Cove, N.Y.

[73] Assignee: Ambico Inc., Lynbrook, N.Y.

[21] Appl. No.: 720,674

[22] Filed: Sep. 7, 1976

[51] Int. Cl.[2] ..... G03D 13/02

[52] U.S. Cl. ..... 354/337; 206/557; 354/327

[58] Field of Search ..... 222/462, 463, 572, 573; 354/331, 337, 338, 297, 299, 327; 206/557, 559, 564, 565; 220/1 H, 1 C; 131/240 R, 241

[56] References Cited

U.S. PATENT DOCUMENTS

| | | | |
|---|---|---|---|
| 633,912 | 9/1899 | Sheppard | 354/337 |
| 1,608,939 | 11/1926 | Hogue | 354/331 |
| 1,886,958 | 11/1932 | Ittem | 222/572 |
| 2,268,457 | 12/1941 | Moore | 354/337 |
| 2,503,308 | 4/1950 | Weiner et al. | 354/331 X |
| 2,974,821 | 3/1961 | Lamont | 131/241 X |
| 3,698,307 | 10/1972 | Reichardt | 354/299 X |
| 3,776,371 | 12/1973 | Linger | 206/564 X |
| 3,829,926 | 8/1974 | Salladay | 222/572 X |

FOREIGN PATENT DOCUMENTS

| | | | |
|---|---|---|---|
| 172542 | 6/1906 | Fed. Rep. of Germany | 354/331 |
| 530904 | 10/1921 | France | 354/331 |
| 21495 | 7/1897 | United Kingdom. | |

*Primary Examiner*—Stanley H. Tollberg
*Assistant Examiner*—Fred A. Silverberg
*Attorney, Agent, or Firm*—Flynn & Frishauf

[57] ABSTRACT

A photographic tray having inwardly turned upper edges, ribs along the lower surface thereof for making the tray more rigid and upwardly sloping bottom surface portions on which the tray may be rocked to agitate a liquid located therein is fabricated as a single, unitary structure by blow molding techniques. The tray is also provided with a pouring spout and with a specially designed molded-in portion for resting a thermometer in the tray so that it will not be dislodged or otherwise inadvertently moved. The tray is fabricated as a closed container by blow molding, and a major surface is then cut off, for example, by sawing, routing, or any other suitable method to arrive at the resultant tray.

13 Claims, 9 Drawing Figures

ROCKABLE PHOTOGRAPHIC TRAY HAVING A SUBSTANTIALLY FLAT INTERIOR SHEET SUPPORT

The present invention relates to photographic trays, and a method of making same, and more particularly, to photographic trays fabricated by a blow molding technique.

Numerous prior art photographic trays are known. However, the various known photographic trays have either functional deficiencies or they are difficult and/or too expensive to fabricate.

The object of the present invention is to provide a photographic tray having several desirable features, and which is yet inexpensive and easy to fabricate.

A further object of the invention is to provide an advantageous method, for example, blow molding, for fabricating the photographic tray of the present invention.

SUMMARY OF THE INVENTION

According to the present invention, an integral, unitary photographic tray structure comprises a bottom member having a first bottom surface portion for resting on a support surface in a stable position and at least one second bottom surface portion which is upwardly inclined relative to the first surface portion in order to permit the tray to be rocked on a support surface. The tray further has side walls integral with each other and integral with the bottom member and extending upwardly therefrom. Inwardly directed side wall portions extend from and are integral with the side walls and extend inwardly toward the central portion of the tray. At least one pouring spout integral with one of the side walls and communicating with the interior of the tray is provided, and rib members are integrally formed in the bottom member.

According to a further feature of the invention, the tray is first fabricated as a unitary closed structure by blow molding, and at least a major part of a major surface thereof is cut off to arrive at the resultant open tray with the side walls thereof having inwardly curved portions.

DETAILED DESCRIPTION

Figure 5:
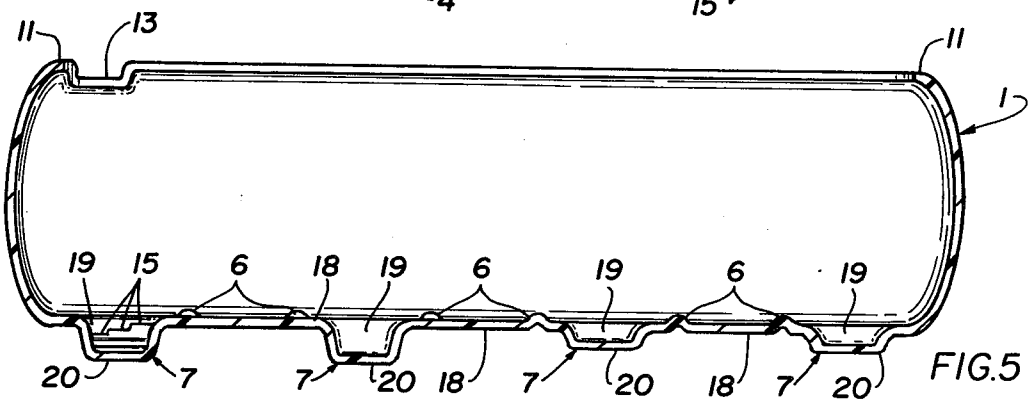
FIG. 5 is a sectional view taken along the line V—V in FIG. 2.
Figure 6:
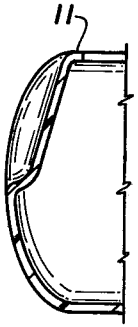
FIG. 6 is a sectional view taken along the line VI—VI in FIG. 3.
Figure 2:
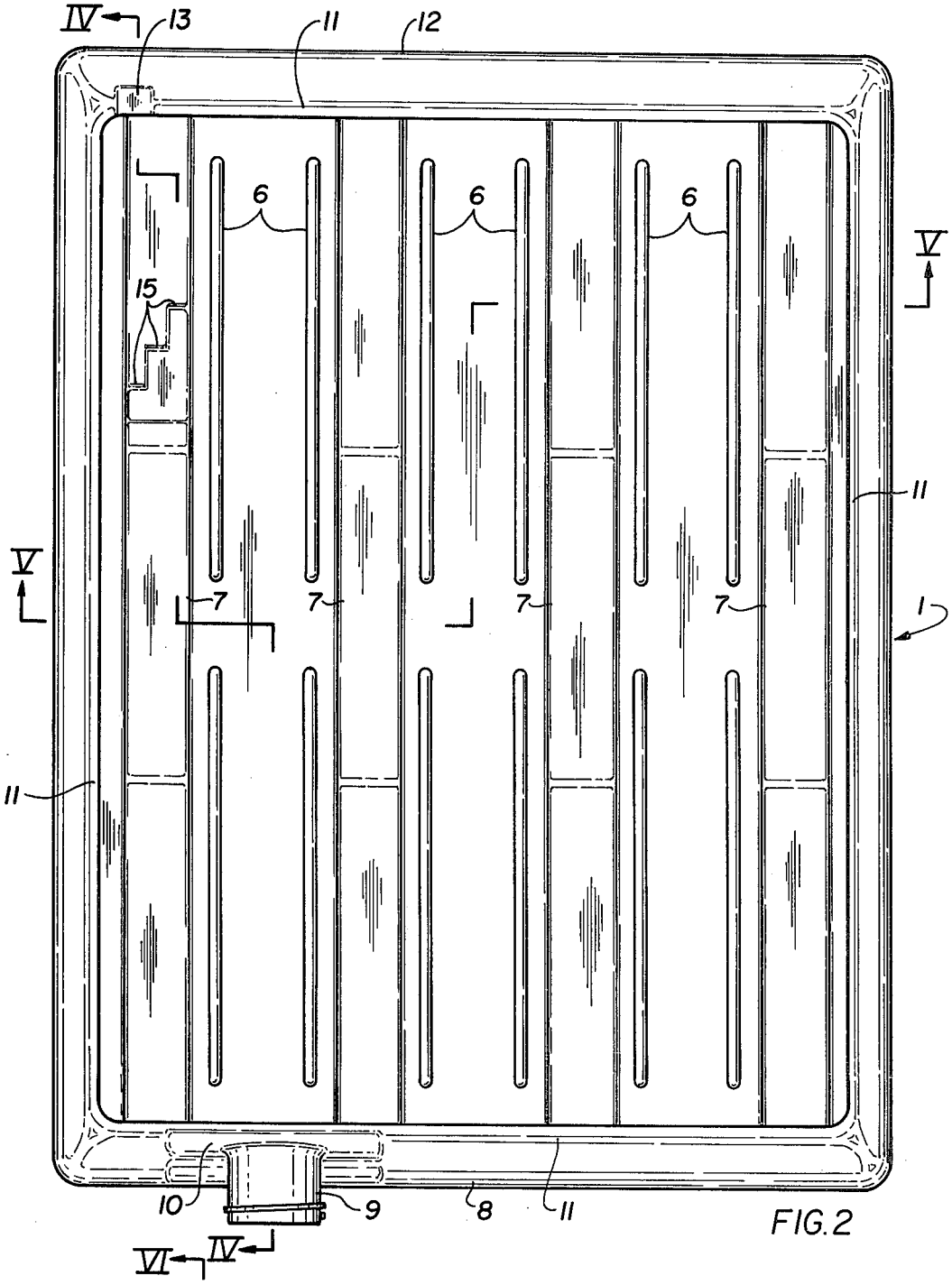
FIG. 2 is a top view of the photographic tray of FIG. 1, drawn to a different scale.
Figure 3:
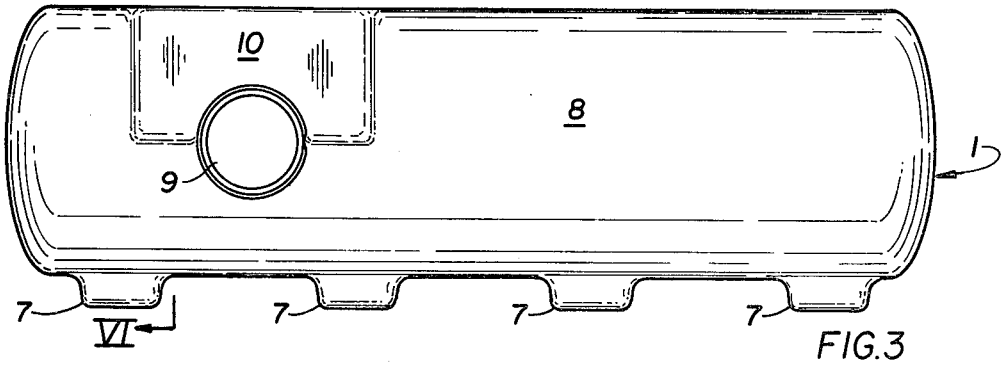
FIG. 3 is an end view of the tray as shown in FIG. 2.
Figure 7:
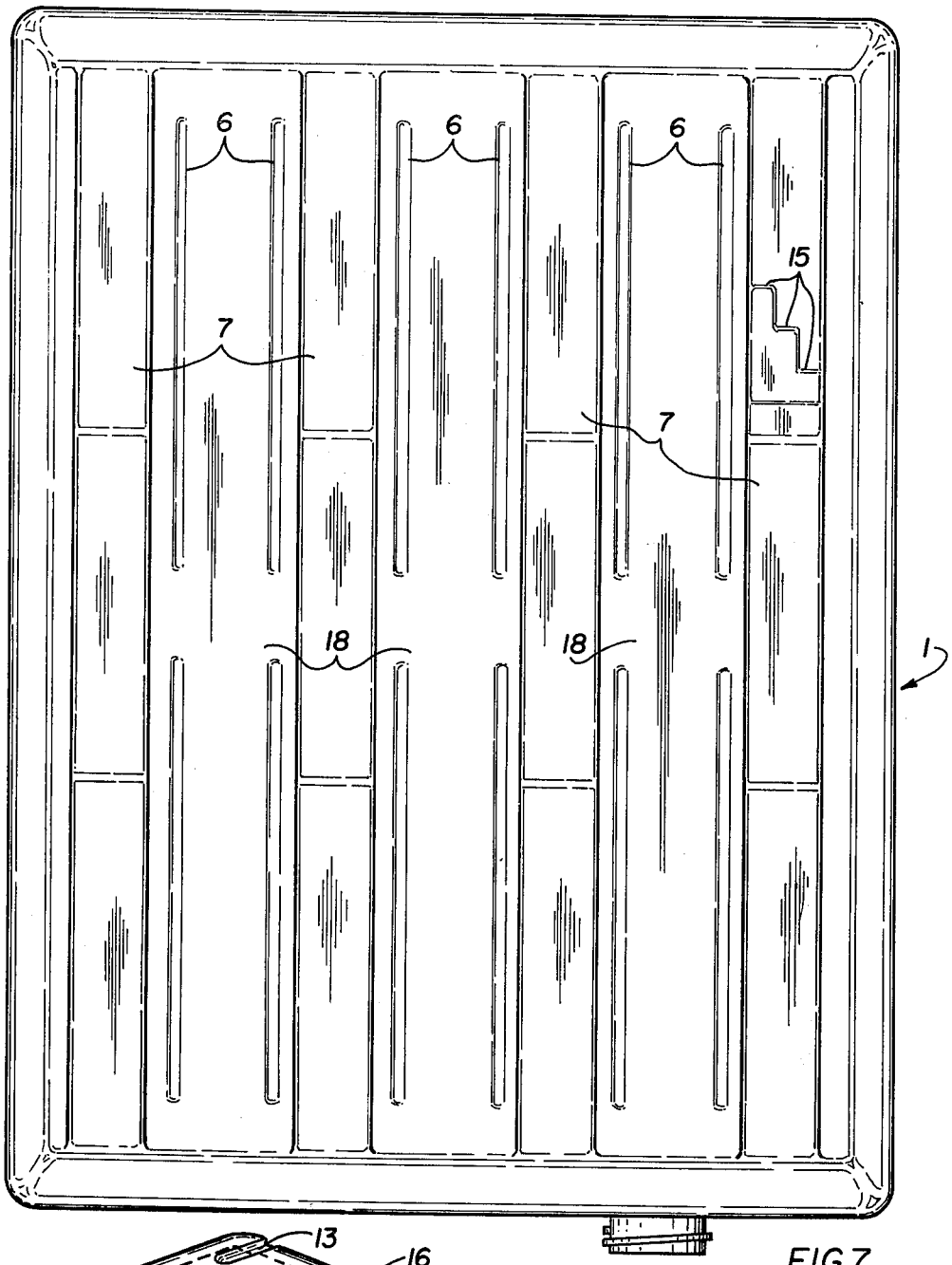
FIG. 7 is a bottom view of the photographic tray of the present invention.

Referring to the drawings, a photographic tray 1 comprises a ribbed bottom having upwardly sloped sides 2 and 3 and a substantially flat portion 4 therebetween. The flat portion 4 is to render the tray stable when resting on a surface 5 and the upwardly sloped portions 2 and 3 are to enable the tray to be rocked back and forth so as to agitate the liquid within the tray. The ribs 6 and 7, as more clearly seen in FIGS. 2, 3 and 5, are integrally molded into the bottom portion of the tray for providing rigidity and strength. By providing the ribs, it is possible to make the tray of a relatively thin material, and to still have high rigidity and structural strength.

Figure 1:
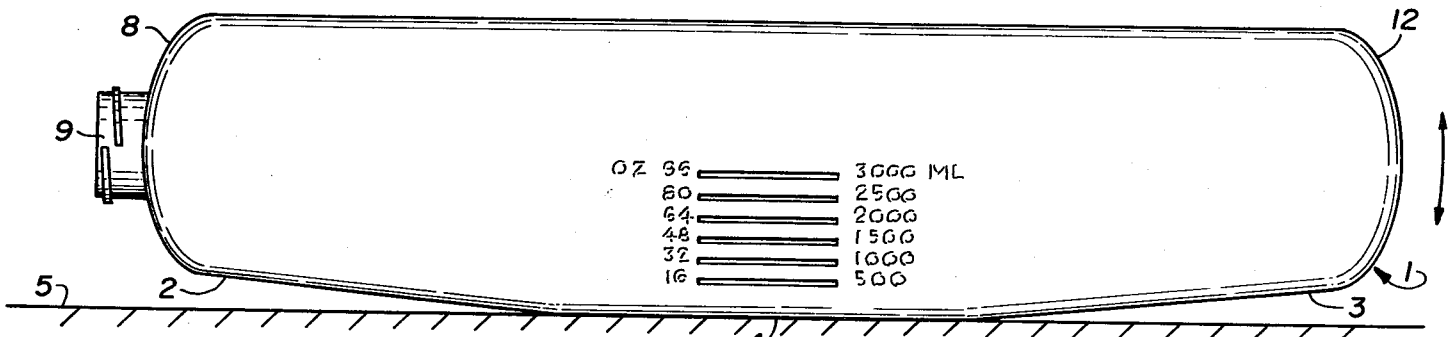
FIG. 1 is a side view of a photographic tray according to the present invention.
Figure 4:
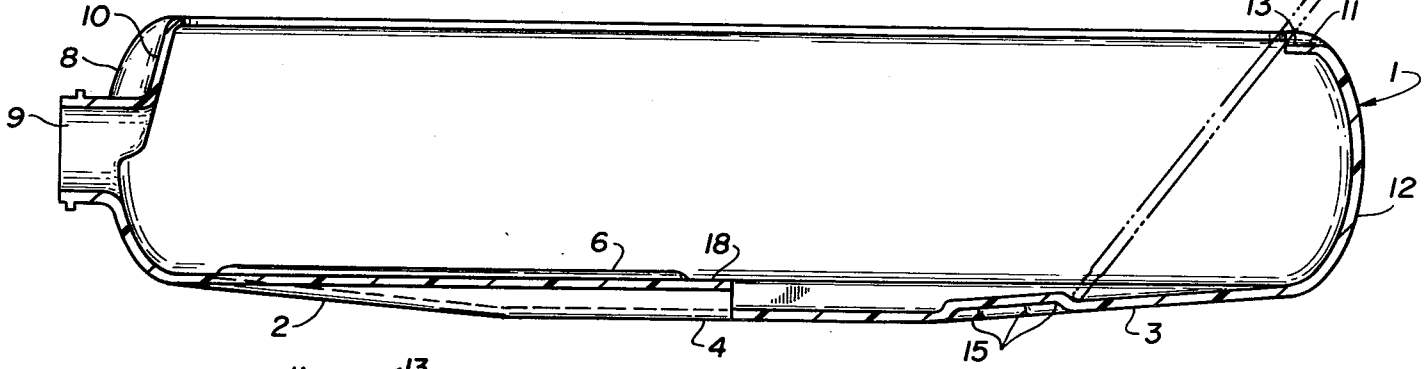
FIG. 4 is a sectional view taken along the line IV—IV in FIG. 2.

The bottom portions 18 between adjacent ribs 7 are designed so as to provide a substantially flat inner surface of the photographic tray. The ribs 6, in addition to increasing the strength of the resulting tray, also serves as projections on which a photographic print, or the like, rests when placed in the tray so as to raise the print off the bottom surface of the tray so as to provide liquid circulation under the print. In addition, the inner channels 19 (FIG. 5) formed by the hollow ribs 7 aid in providing improved liquid circulation below the print placed in the tray. The bottom surfaces 20 of the ribs 7 provide the straight surface 4 (FIGS. 1 and 4) and the upwardly sloping surfaces 2 and 3 (FIGS. 1 and 4).

A side wall 8 of the tray has a threaded pouring spout 9 integrally molded therewith for facilitating adding liquids to the tray and/or draining liquids from the tray. A portion 10 of the side wall 8 is set back to enable the user of a tray to more firmly grip a threaded coupling which is secured to the threaded spout 9 to facilitate tightening or loosening thereof on the spout 9.

The side walls of the tray each have inwardly turned-in edges 11 to prevent liquid in the tray from splashing out of the tray when the tray is rocked about flat portion 4 to agitate the contents of the tray, or when the contents of the tray are otherwise agitated. The particular shape and size of the turned-in edges 11 of the tray are not significant, but the fact that they are provided on all four sides is an important feature which is extremely advantageous in use. The turned-in edges 11 are all integral with each other and are integral with the respective sides of the tray, as will become more apparent from the discussion below of the method of making the tray.

The side wall 12 of the tray which is opposite the side wall 8 has an indentation 13 (best seen in FIGS. 4 and 5) so as to form a bed or resting place for a thermometer which may be inserted into the contents of the tray. As an example, a thermometer 14 is shown in dashed lines in FIG. 4 as it is typically inserted into the tray of the present invention. The bottom surface of the tray has stepped portions 15 which help retain a thermometer 14 in place in the photographic tray. In the illustrated embodiment, three steps 15 are shown. Thus, three thermometers, or the like, could be advantageously located in the tray adjacent to each other without interferring with each other. While the thermometer resting place 13 is shown on the wall 12, it may be located in other positions on the tray, as desired.

The provision of the turned-in edges 11, in combination with the pouring spout 9 provides a further advantage in that the tray may be tipped in order to pour solution from the tray through the spout 9 substantially without the danger of the contents of the tray spilling or splashing out of the tray. A side wall of the tray has, for convenience, markings thereon to indicate the quantity of liquid in the tray. See FIG. 1. The side walls are preferably curved, as shown on the drawings to still further improve the splash prevention characteristics of the tray.

Figure 8:
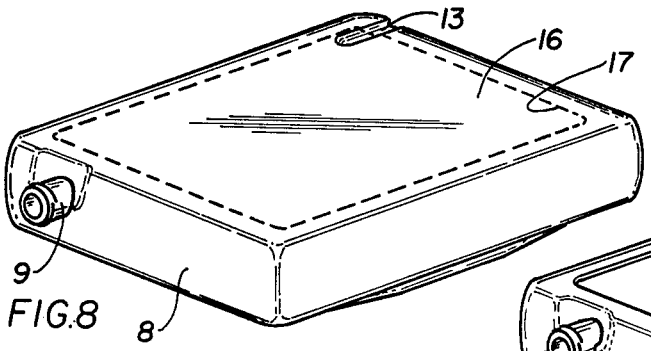
FIG. 8 is a perspective view of a blow-molded product from which the tray of the present invention is fabricated.

In accordance with the present inventive concept, it has been discovered that the only economical way of fabricating a tray in accordance with the present invention is to utilize a blow molding technique. Blow molding techniques, per se, are generally well known in the art and are widely used for fabricating hollow containers of plastic material. In accordance with the present invention, a hollow container generally of the shape of the photographic tray of the present invention is fabricated by a conventional blow molding technique. Since blow molding techniques are so widely known in the art, further detailed discussion thereof is not given herein. The result of making the hollow closed container generally in the shape of a photographic tray is shown in FIG. 8. The spout 9 and the thermometer resting place 13 are integrally molded with the hollow container as shown in FIG. 8. These portions are easily fabricated by proper fabrication of the mold from which the article is made.

Figure 9:
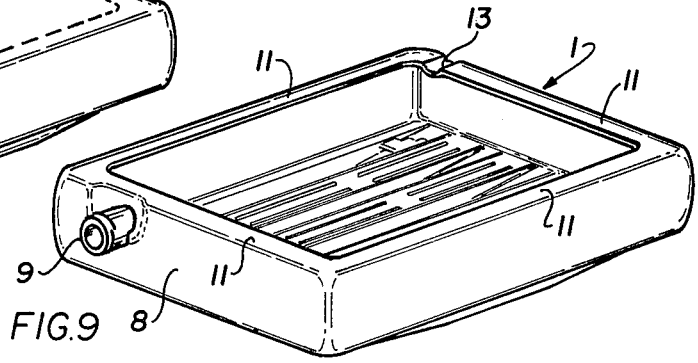
FIG. 9 is a perspective view, similar to FIG. 8, showing the product of FIG. 8 after it is formed into a photographic tray according to the present invention.

After fabrication of the closed hollow container the major surface 16 is removed, for example by sawing, cutting, routing, or any other suitable method, along the dashed line 17, to arrive at the photographic tray with inwardly turned edges 11 shown in FIG. 9. The resultant photographic tray thus is integrally formed with undercuts which are virtually impossible to obtain by other methods, and with integral ribs or other reinforcing projections on the bottom surface thereof in order to increase the strength and rigidity of the resultant product and with an integral pouring spout. It has heretofore not been possible to obtain a photographic tray having the above described combination of features in a single, integral, unitary, molded plastic structure.

Instead of cutting on line 17, the cut may be made adjacent the sides and the inward curvature of the sides will provide the desired effect. The sides may have a greater curvature than shown in the drawings as desired.

In a typical example, the tray is fabricated of high density polyethylene and has a nominal thickness of 0.100 inches.

While the photographic tray and method of making same has been described in connection with a specific embodiment, it should be clear that various alterations and modifications may be made within the spirit and scope of the invention as defined in the appended claims.

I claim:

1. An integral, unitary, molded plastic photographic tray structure comprising:

a bottom member having a first bottom portion defining on the outer surface of said tray a first substantially flat bottom area for resting on a support surface in a stable position, and a pair of second bottom portions each of which, on the outer surface of said tray, define upwardly inclined bottom areas relative to said first substantially flat bottom area to permit the tray to be rocked on the support surface, said second bottom surface portions being respectively located on opposite sides of said first bottom portion;

said bottom member defining a substantially flat, photographic sheet receiving, lower surface on the inside of the tray over said first substantially flat bottom area and over at least a substantial portion of said upwardly inclined bottom areas for permitting a photographic sheet to remain in its flat state over substantially the complete interior area of the tray;

side walls integral with each other and integral with said bottom member, said side walls extending completely around and upwardly from said bottom member to form said tray;

an inwardly directed integral lip portion extending from the upper portions of said side walls and integral with said side walls, said lip portion extending completely along and around said side walls and inwardly toward the central portion of the tray;

at least one pouring spout integral with at least one of said side walls and communicating with the interior of the tray, said pouring spout having threads thereon for receiving a mating threaded member, and said at least one side wall which is integral with said pouring spout having a setback or a recessed portion remote from said threads to facilitate manipulating the threaded member on the threads of said spout; and a plurality of elongated rib members integrally formed in said bottom member and extending in a given direction of the tray.

2. A photographic tray according to claim 1 comprising means on at least said inwardly directed lip portion for defining a thermometer resting place.

3. A photographic tray according to claim 2 wherein said means for defining said thermometer resting place comprises an indentation on said inwardly directed lip portion.

4. A photographic tray according to claim 1 wherein said side walls are inwardly curved, the upper portions thereof comprising said lip portion.

5. A photographic tray according to claim 1 wherein at least a plurality of said rib members present outer tray surfaces defining said substantially flat bottom area and said upwardly inclined bottom areas of said bottom member, and portions of said bottom member located between at least a plurality of said ribs present inner tray surfaces defining said substantially flat lower inside surface of the tray.

6. A photographic tray according to claim 1 wherein said tray is generally rectangular in shape, and said ribs extend in the longitudinal direction of the tray.

7. An integral, unitary, molded plastic photographic tray structure comprising:

a bottom member having a first bottom surface portion defining on the outer surface of said tray a first substantially flat bottom area for resting on a support surface in a stable position, and a pair of second bottom portions each of which, on the outer surface of said tray, define upwardly inclined bottom areas relative to said first substantially flat bottom area to permit the tray to be rocked on the support surface, said second bottom surface portions being respectively located on opposite sides of said first bottom portion;

side walls integral with each other and integral with said bottom member, said side walls extending completely around and upwardly from said bottom member to form said tray;

an inwardly directed integral lip portion extending from the upper portions of said side walls and integral with said side walls, said lip portion extending completely along and around said side walls and inwardly toward the central portion of the tray;

at least one pouring spout integral with at least one of said side walls and communicating with the interior of the tray;

a plurality of elongated rib members integrally formed in said bottom member and extending in a given direction of the tray; and a multi-stepped portion integrally formed in a given rib member of the tray for defining at least two thermometer retaining levels in said given rib member in the depthwise direction of the tray.

8. A photographic tray according to claim 7 comprising an indentation in at least said inwardly directed lip portion for defining a thermometer resting place.

9. A photographic tray according to claim 7 wherein said side walls are inwardly curved, the upper portions thereof comprising said lip portion.

10. A photographic tray according to claim 7 wherein said pouring spout has threads thereof for receiving a mating threaded member, and said at least one side wall which is integral with said pouring spout has a setback or recessed portion remote from said threads to facilitate manipulating a threaded member on the threads of said spout.

11. A photographic tray according to claim 7 wherein said tray is generally rectangular in shape, and said ribs extend in the longitudinal direction of the tray.

12. A photographic tray according to claim 7 wherein said bottom member defines a substantially flat, photographic sheet receiving, lower surface on the inside of the tray over said first substantially flat bottom area and over at least a substantial portion of said upwardly inclined bottom areas for permitting a photographic sheet to remain in its flat state over substantially the complete interior area of the tray.

13. A photographic tray according to claim 12 wherein at least a plurality of said rib members present outer tray surfaces defining said substantially flat bottom area and said forwardly inclined bottom areas to said bottom member, and portions of said bottom member located between at least a plurality of said ribs present inner tray surfaces defining said substantially flat lower inside surface of the tray.

* * * * *